United States Patent [19]

Salomons

[11] 4,019,673

[45] Apr. 26, 1977

[54] CARDBOARD BOX

[75] Inventor: Arnold Salomons, Amersfoort, Netherlands

[73] Assignee: Gladu A.G., Glarus, Switzerland

[22] Filed: Apr. 2, 1976

[21] Appl. No.: 673,105

[30] Foreign Application Priority Data

Apr. 8, 1975 Netherlands ..... 7504187

[52] U.S. Cl. ..... 229/17 R; 229/51 D

[51] Int. Cl.[2] ..... B65D 5/72

[58] Field of Search ..... 229/51 D, 51 TC, 17 R

[56] References Cited

UNITED STATES PATENTS

| | | | |
|---|---|---|---|
| 1,712,249 | 5/1929 | Byrne | 229/51 D X |
| 2,105,547 | 1/1938 | Mergentheim | 229/17 R |
| 2,979,249 | 4/1961 | Gill | 229/17 R |
| 3,147,905 | 9/1964 | Gill | 229/51 TC X |
| 3,395,848 | 8/1968 | Johnson | 229/17 R |

FOREIGN PATENTS OR APPLICATIONS

| | | | |
|---|---|---|---|
| 603,543 | 6/1948 | United Kingdom | 229/51 D |

*Primary Examiner*—Davis T. Moorhead

[57] ABSTRACT

A cardboard box, provided with an outlet opening in a multilayered wall portion, which is closed by means of a closing lip which can be swung open and reclosed and which is formed from a plurality of layers of box material that have been glued together, wherein the closing lip, having been opened, is clampingly reclosable on account of the fact that this closing lip, when swung back to the reclosed position, is capable of being pressed farther into the box over the whole width of its free end than in the original closed position.

2 Claims, 6 Drawing Figures

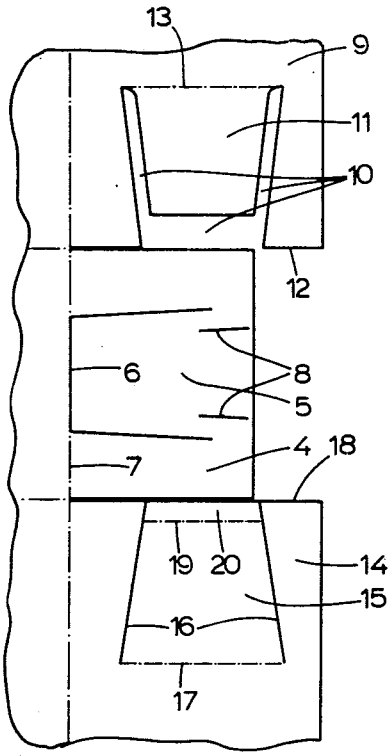
fig.3
fig.5
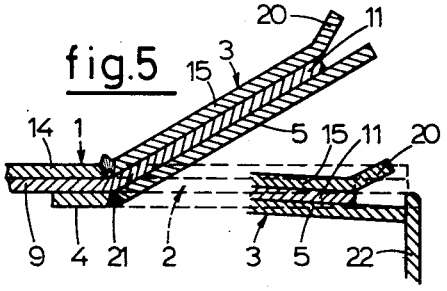
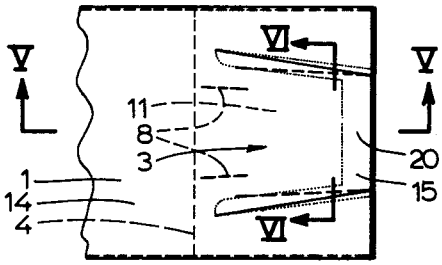
fig.4
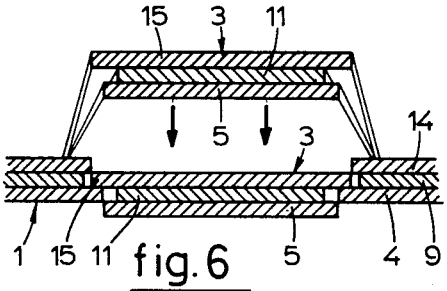
fig.6

CARDBOARD BOX

BACKGROUND OF THE INVENTION

The invention relates to a cardboard box, provided with an outlet opening in a multilayered wall portion, which is closed by means of a closing lip which can be swung open and reclosed and which is formed from a plurality of layers of box material that have been glued together.

Known embodiments of such cardboard boxes have the disadvantage that the matter in which the closing lip is reclosed is inadequate, since the forces which are to retain the closing lip in the reclosed position are weak.

SUMMARY OF THE INVENTION

It is an object of the present invention to provide a cardboard box which shows a major improvement in this respect.

To this end, the cardboard box according to the invention is characterized in that the closing lip, having been opened, is clampingly reclosable on account of the fact that this closing lip, when swung back to the reclosed position, is capable of being pressed farther into the box over the whole width of the free end than in the original closed position.

The different position of the closing lip in the reclosed state as compared to that in the original closed state allows attaining substantial clamping forces upon this closing lip in its reclosed position.

If the wall portion in which the outlet opening is formed is three-layered, the contours of the closing-lip layers and of the openings which are present in the layers of the wall portion after the closing lip has been swung open and which together form the outlet opening, may be so dimensioned that the closing-lip layer formed from the outer box layer strikes the inner box layer when being reclosed.

In this manner, the closing lip is prevented from being pressed too far into the box during the reclosing operation.

A very important embodiment of the box according to the invention, likewise comprising a three-layered closing lip, is characterized in that the middle closing-lip layer is bounded by a cutout portion and is shorter and narrower than the outer and inner closing-lip layers, the cutout portion in the middle box layer being so dimensioned as to limit glue joint between the outer and inner closing-lip layers with the middle box layer exclusively to the middle closing-lip layer.

In this embodiment of the box according to the invention, the incisions and cutout portions for forming the outlet opening and the closing lip may have great tolerances without impairing the proper functioning in any way.

BRIEF DESCRIPTION OF THE DRAWINGS

The invention will hereinafter be explained with reference to the drawing, which illustrates an embodiment of the box according to the invention by way of example.

FIG. 3 shows a portion of the blank of the box according to FIG. 1 on an enlarged scale.

FIG. 4 is a top view of a portion of the top wall of the box according to FIG. 1, in which the outlet opening, closed by the closing lip, has been formed.

FIG. 5 is a section taken along line V—V in FIG. 4 on a larger scale, the closing lip being shown in the open and in the reclosed position.

FIG. 6 is a section taken along line VI—VI in FIG. 4 on a larger scale, the closing lip being shown in the open and in the reclosed position.

DESCRIPTION OF A PREFERRED EMBODIMENT

Figure 1:
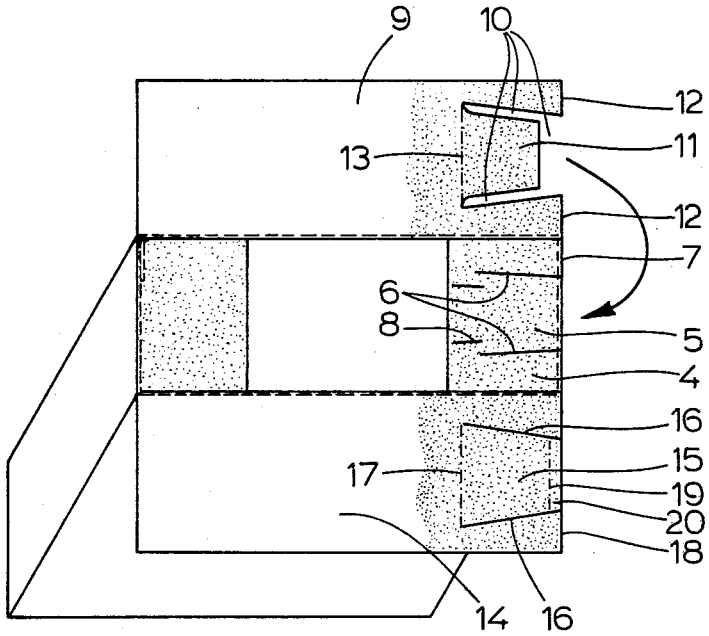
FIG. 1 is a perspective view of a cardboard box according to the invention, which is still in the unclosed state and in which an outlet opening and closing lip have been formed in the top wall.

FIGS. 1–6 illustrate a first embodiment of a cardboard box according to the invention. At a location where the wall 1 consists of three layers, an outlet opening 2 is formed in this wall 1, which in the figures is the top wall of the box, but which naturally can also be any other wall. This outlet opening 2, which in the embodiment shown is located at the edge of the wall 1, is closed by means of a closing lip 3 which can be swung open and reclosed and which is composed of three layers of box material that have been glued together.

In a short flap 4, forming the inner box layer in the embodiment shown, a trapezoidal inner closing-lip layer 5 is bounded by incisions 6, which are interrupted in order to retain this closing-lip layer 5 in the plane of the flap 4 before the closing lip 3 is swung open. One of the incisions 6 follows the fold line 7 of the flap 4 and may even form, in the blank according to FIG. 3, the left-hand boundary of this fold line 7.

This flap 4 further contains two weakening lines or incisions 8, which are substantially perendicular to the eventual fold line of the inner closing-lip layer 5 and which extend substantially to the inside edge of the flap 4.

Figure 2:
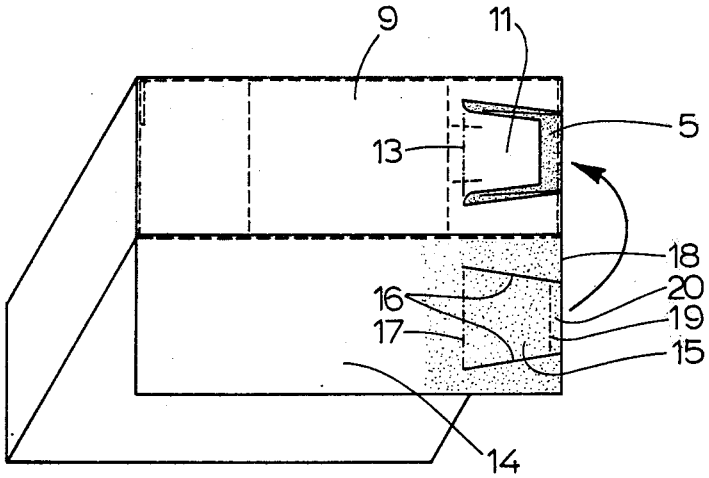
FIG. 2 is a view corresponding to that of FIG. 1, after one of the long flaps of the top wall has been swung to the closed position.

The inner box layer formed by the short flaps 4, as indicated in FIGS. 1 and 2, is covered in its entirety with a layer of glue.

A long flap 9, which constitutes the middle box layer and which, as indicated in FIGS. 1 and 2, is the first to be swung to the closed position, comprises on one side a cutout portion 10 which is more or less V-shaped and which gives rise to the formation of a trapezoid middle closing-lip layer 11 which, in the closed position of this flap 9 (FIG. 2), is glued onto the inner closing-lip layer 5. This middle closing-lip layer 11 is both shorter and narrower than the inner closing-lip layer 5 (FIG. 2). Accordingly, the middle closing-lip 11 ends at some distance from the edge 12 of the flap 9. A fold line 13 for the middle closing-lip layer 11 is preformed in the flap 9. The flap 9 is covered over its entire surface with a layer of glue and is thus glued onto the short flaps 4 when swung to the closed position.

In the opposite long flap 14, which constitutes the outer box layer and thus is the last to be swung to the closed position, a trapezoid outer closing-lip layer 15 is bounded by interrupted incisions 16, a fold line 17 whicch has been preformed in the flap 14, and the edge 18 of the flap 14. Further, a second fold line 19 is preformed in this outer closing-lip layer 15 near the edge 18. The flap 14 is likewise covered over its entire surface with a layer of glue. When the flap 14 has been swung to the closed position and the flaps 4, 9 and 14 have been glued together, the closing-lip layers 5, 11 and 15 have likewise been joined together by gluing.

The middle closing-lip layer 11 is shorter and narrower than the outer and inner closing-lip layers 5 and 15, respectively, while the cutout protion 10 from the long flap 9 is wider than the inner and outer closing-lip layers 5, 15 and extends to the edge 12 of the long flap 9.

This ensures that the closing-lip layers 5, 11, 15, which are preformed in the blank of the box (FIG. 3) and are only glued onto each other when the box is closed, are always joined exclusively to each other by the glue, even when there are small variations in their position of the kind that may be caused, for instance, by the folding operation. This prevents one or more closing-lip layers 5, 11, 15 from being glued onto the box material located outside the closing lip 3 and formed by the flaps 4, 9 and 14, which would make it extremely difficult and sometimes even impossible to open the closing lip 3.

Further, as shown particularly in FIGS. 3–6, the outer closing-lip layer 15 has larger dimensions, viewed in the transverse direction, than the inner closing-lip layer 5.

In opening the closing lip 3, it is gripped by the terminal portion 20 of the outer closing-lip layer 15, which terminal portion 20 serves as a gripping element and is bent outwardly along the fold line 19. Gripping and holding this terminal portion 20 is facilitated by the underlying cutout portion 10 in the flap 9. The application of tensile force causes the closing lip 3 to be torn loose and swung outwardly in the manner shown in FIGS. 5 and 6. During this operation, which is facilitated by the weakening lines or incisions 8, the inner closing-lip layer 5 will be slightly stretched at the location of the fold 21, which stretch is maintained when the closing lip 3 is swung back to the reclosed position.

Once the closing lip 3 has been opened, it is clampingly reclosable, since this closing lip 3, when being swung back to the reclosed position, is capable, over the whole width of its free end, of being pressed farther into the box than in the original closed position (FIGS. 5 and 6). The contours of the closing-lip layers 5, 11 15 and of the cutout portion 10 in the flap 9, are so dimensioned that the outside closing-lip layer 15 when being reclosed strikes the inside box layer constituted by a short flap 4. Upon reclosing the closing lip 3, the free terminal edge of the inner closing-lip layer 5 will be subjected to a clamping force applied by the upright wall 22 of the box, causing the closing lip 3 to be held firmly in its place in the reclosed position.

The invention is not restricted to the embodiments shown in the drawing, which may be varied in several ways within the scope of the appended claims.

I claim:

1. A cardboard box comprising a three layered wall portion provided with an outlet opening, a closing lip which can be swung open and reclosed to open and close said outlet opening, said lip being constituted by the three layers of material of the box that have been glued together, the middle closing-lip layer being bounded by a cutout portion and being shorter and narrower than the outer and inner closing-lip layers, so that the closing lip, after having been opened, is clampingly reclosable since said closing lip, when swung back to the reclosed position, is capable of being pressed over the entire width of its free end, one layer of box material farther into the box than in the original closed position.

2. A box according to claim 1 wherein the inner layer contains weakening lines which are substantially perpendicular to the fold line of the inner closing-lip layer.

* * * * *